US005129246A

United States Patent [19]

Strickland et al.

[11] Patent Number: 5,129,246

[45] Date of Patent: Jul. 14, 1992

[54] TUBING EXPANDER

[75] Inventors: John T. Strickland, Memphis; Douglas B. Laird, Collierville, both of Tenn.

[73] Assignee: Ardco, Inc., Chicago, Ill.

[21] Appl. No.: 686,993

[22] Filed: Apr. 18, 1991

[51] Int. Cl.[5] ..... B21D 41/02; B21D 53/06

[52] U.S. Cl. ..... 72/21; 72/316; 72/370; 72/443; 72/447; 72/449; 29/727; 74/89.21

[58] Field of Search ..... 72/393, 316, 318, 370, 72/449, 443, 21, 447; 29/727, 726; 74/89.21

[56] References Cited

U.S. PATENT DOCUMENTS

| | | | |
|---|---|---|---|
| 2,480,629 | 8/1949 | Brinen | 153/80 |
| 3,047,095 | 7/1962 | Bell | 74/89.21 |
| 3,358,492 | 12/1967 | Richter | 72/393 |
| 3,482,299 | 12/1969 | Davidson | 29/727 |
| 3,683,481 | 8/1972 | Blackburn | 29/727 |
| 3,789,648 | 2/1974 | Ames | 29/727 |
| 3,981,172 | 9/1976 | Hess et al. | 72/370 |
| 4,639,994 | 2/1987 | Cooper | 29/727 |
| 4,672,741 | 6/1987 | Zafred | 29/726 |
| 4,688,985 | 8/1987 | Hartman | 74/89.21 |
| 4,779,445 | 10/1988 | Rabe | 72/393 |
| 4,821,391 | 4/1989 | Paterick | 29/253 |

FOREIGN PATENT DOCUMENTS

| | | | |
|---|---|---|---|
| 583829 | 1/1925 | France | 29/727 |
| 1163846 | 10/1958 | France | 72/457 |
| 118922 | 5/1987 | Japan | 72/393 |

*Primary Examiner*—Daniel C. Crane
*Attorney, Agent, or Firm*—Walker & McKenzie

[57] ABSTRACT

A mechanical expander for tubing for heat transfer products. The tubing expander includes one or more elongated rods, each having an enlargement on the forward end thereof for insertion into tubing to be expanded. The rods are supported on a carriage which in turn is slidably mount on a frame. The carriage is driven forwardly and rearwardly along the frame by a hydraulic motor operably coupled to the carriage by a continuous chain. Elongated tubes which are respectively fixedly attached to a cross member and which respectively partially surround the rods limit lateral or bowing movements of the rods. There are clamping jaws mounted on the frame for clampingly holding the ends of the tubing to be expanded. The rods along with the supports thereof are removably mounted on the carriage, the cross member is removably mounted on the frame, and the clamping jaws are removably mounted on the frame, so that the number of the rods, supports, elongated tubes, and clamping jaws may be changed to accommodate the number and center line spacing of the tubes in the coils to be expanded. A programmable logic controller controls the motion of the carriage during the operation of the expander.

8 Claims, 5 Drawing Sheets

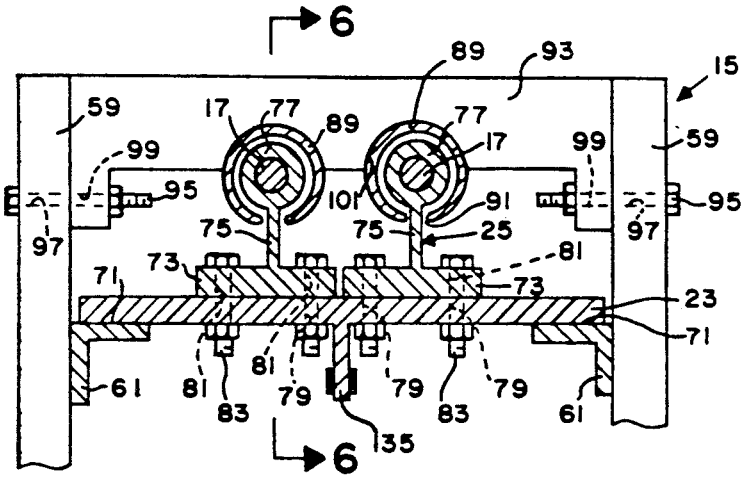
FIG. 4
FIG. 5
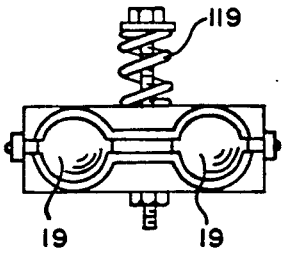
FIG. 6
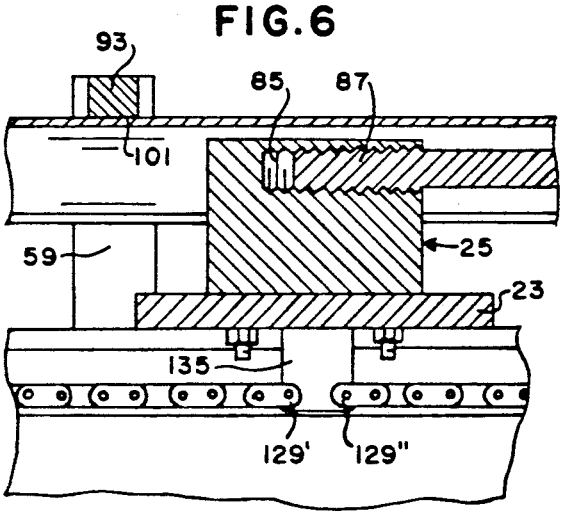
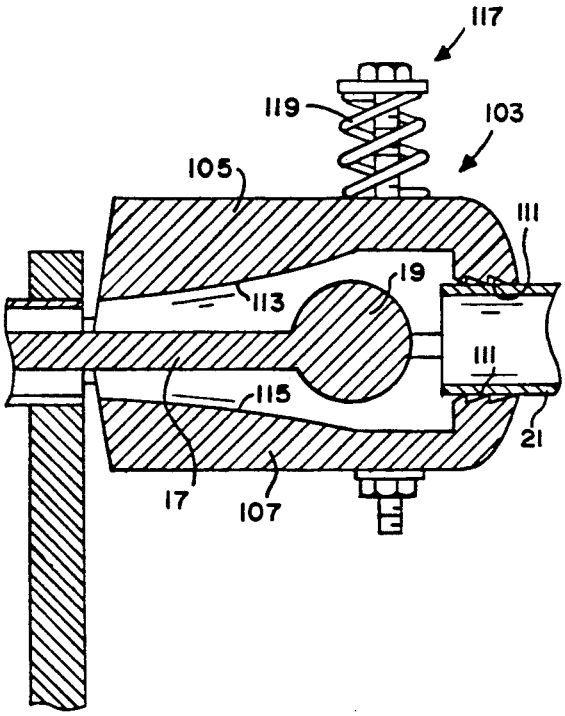
FIG. 7
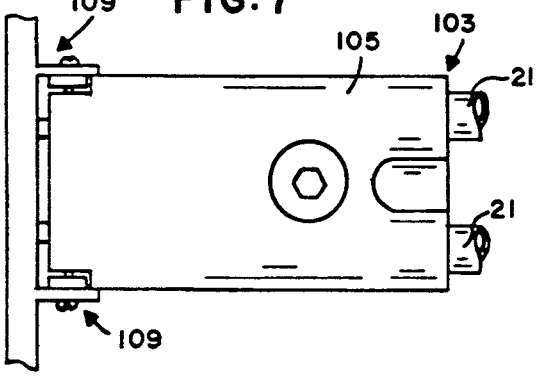
FIG. 8
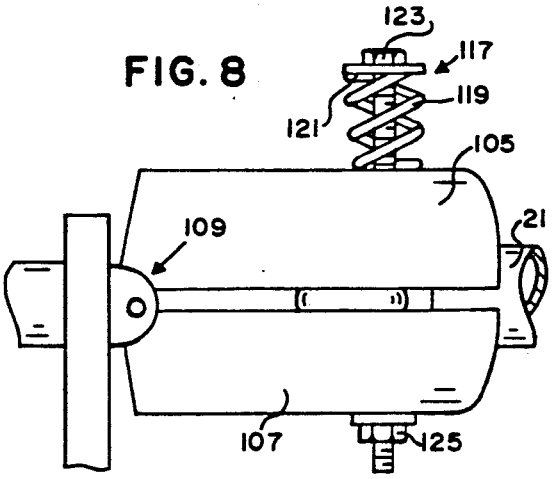

FIG. 10
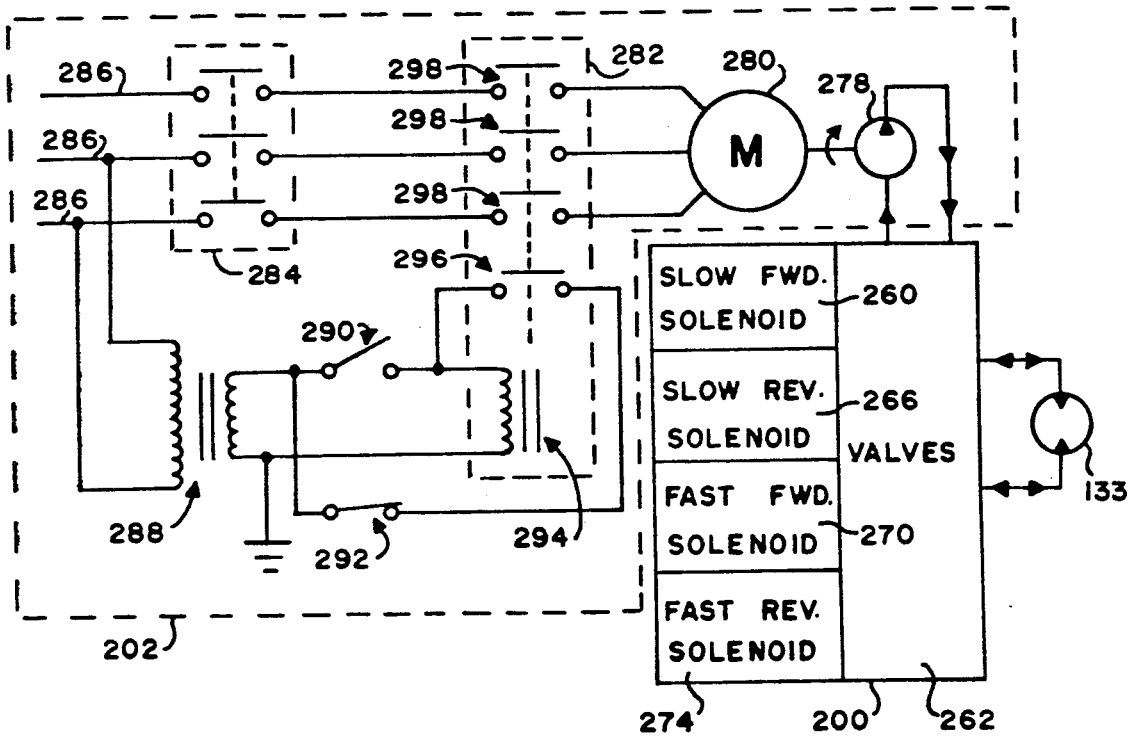
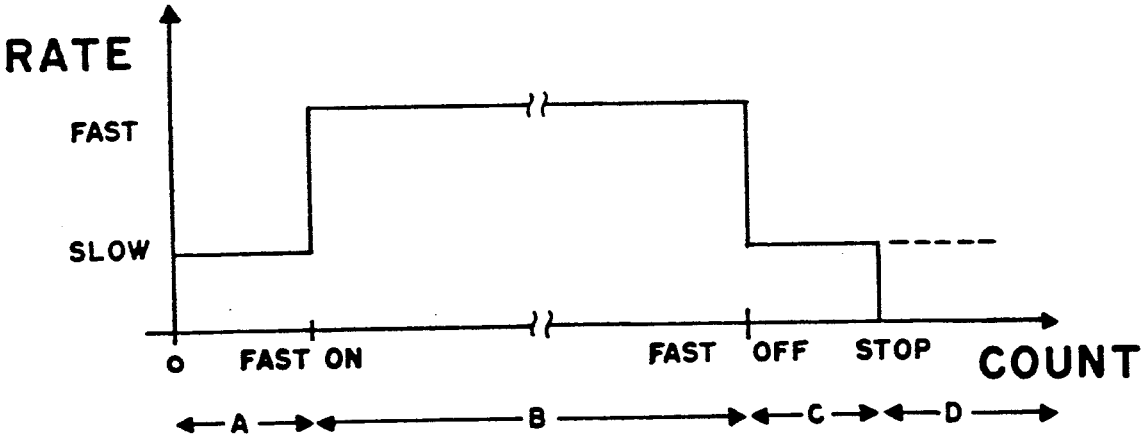
FIG. 11

TUBING EXPANDER

BACKGROUND OF THE INVENTION

1. Field of the Invention

The present invention relates, in general, to a mechanical expander for tubing for heat transfer products.

2. Information Disclosure Statement

A preliminary patentability search in class 72, subclass 393, disclosed the following patents which may relate to the present invention: Brinen, U.S. Pat. No. 2,480,629 issued Aug. 30, 1949; Richter, U.S. Pat. No. 3,358,492 issued Dec. 19, 1967; Hess et al., U.S. Pat. No. 3,981,172 issued Sept. 21, 1976; Rabe, U.S. Pat. No. 4,779,445 issued Oct. 25, 1988; and Paterick, U.S. Pat. No. 4,821,391 issued Apr. 18, 1989 may relate to the present invention.

Brinen discloses a hand held tool for beading and flaring the ends of metal tubes into a header plate.

Richter discloses an expandable mandrel for expanding a tubular member. The mandrel automatically retracts as the rod is initially passed through the bore of a tube, and which mandrel automatically expands to effect the expansion of the tube on reversing of the direction of the mandrel through the tube to be expanded.

Hess et al. discloses a method and apparatus for expanding long lengths of large diameter spirally wound and helically welded pipe. The apparatus includes a radially expandable die head assembly for incrementally expanding the pipe advanced over the die head and wherein the die head has a helical groove which corresponds to the helical weld seam of the pipe.

Rabe discloses an elongated tool device for use in installing a tubular sleeve within a tube and forming a pressure-tight seal therebetween. The tool device contains dual internal pistons which are pressurized in sequence to expand collet fingers radially into the close-fitting sleeve and provide a leak-tight seal between the sleeve and surrounding tube.

Paterick discloses an apparatus for forming a muffler mechanical lock joint, and the resulting assembly. The apparatus includes a punch, a wedge, a drive, and a return means. The punch is radially expandable and provides for deforming a flange and tube of muffler components into a mechanical lock joint, while the punch is radially expanded. The wedge is axially movable, and wedges the punch into radial expansion when axially moved.

Applicant has knowledge of expanders of the so-called pinch-roller or slip drive type wherein rods are used to expand tubes. The slip drive type expander utilizes pairs of oppositely turning rollers that drive the rods longitudinally. With the use of such slip drive expanders the rollers pinch the rods causing the rods to wear out. Also the rods break and must be hardened. Thus, the pinch-roller type of machine is expensive to maintain.

Also, applicant has knowledge of vertically oriented expanders having a large cylinder with the piston rod thereof attached to a plate to which in turn is attached a plurality of rods. Although particularly suitable for high production for the expansion of tubing of heat transfer coils having the same center-to-center spacing of the tubes, such vertically oriented expanders cannot be quickly changed from heat transfer coils having one particular center-to-center dimension of the tubes to another. Also, such vertically oriented expanders are not suitable for expanding U or hair-pin tubes because there is the problem of the rods damaging the tubes by projecting through the end of the U turn in the tubes.

In addition, applicant has knowledge of hand held expanders which are slow in operation and unwieldy to handle, particularly if long rods are utilized.

SUMMARY OF THE INVENTION

The present invention is directed toward providing an improved tubing expander which overcomes previous problems and drawbacks of prior tubing expanders. The expander of the present invention includes one or more elongated rods, each having an enlargement on the forward end thereof for insertion into tubing to be expanded. The rods are supported on a carriage which in turn is slidably mounted on a frame. The carriage is driven forwardly and rearwardly along the frame by a hydraulic motor operably coupled to the carriage by a continuous chain. Elongated tubes, which are respectively fixedly attached to a cross member and which respectively partially surround the rods, limit lateral or bowing movements of the rods. There are clamping jaws mounted on the frame for clampingly holding the ends of the tubing to be expanded.

There are means removably mounting the rods along with the supports thereof on the carriage, means removably mounting the cross member on the frame, and means removably mounting the clamping jaws on the frame, whereby the number of the rods, supports, elongated tubes, and clamping jaws may be changed to accommodate the number and centerline spacing of the tubing or tubes in the coils to be expanded. Thus, this changeability of the above mentioned components provides a very versatile tube expander which is particularly useful for a custom type operation in the field of heat transfer products.

One of the objects of the present invention is to provide a tube or tubing expander that is versatile so that the expander may be quickly and easily changed from one tube spacing to another or one size coil to another and yet provide an expander that is fast in operation.

A further object is to provide a tubing expander which can be quickly and easily changed so that it can expand 1, 2, or as many as 12 tubes at a time.

A further object is to provide a tubing expander that can expand both legs of a U-bend in tubes at the same time.

A further object is to provide a tubing expander that is provided with a direct drive of the expander rod or rods as opposed to slip drive types of tubing expanders.

A further object is to provide a tubing expander that requires less maintenance than the slip drive type of expander.

A further object is to provide a tubing expander that can expand great lengths of tubing, as for example tubes of 24 foot lengths.

A further object is to provide an expander that is particularly useful in custom shops where versatility is needed in expanding many different sizes of coils throughout the day, and yet a high production rate can be maintained.

A further object is to provide an expander that is highly effective and in which accuracy is provided in the expanding operation.

BRIEF DESCRIPTION OF THE DRAWINGS

FIG. 4 is an enlarged sectional view taken as on the line 4—4 of FIG. 2, with portions removed for purposes of clarity.

FIG. 5 is an end elevational view of a portion of the tubing expander of the present invention.

FIG. 6 is an enlarged sectional view taken as on the line 6—6 of FIG. 4.

FIG. 7 is a top plan view of that shown in FIG. 5.

FIG. 8 is a side elevational view of that shown in FIG. 7.

FIG. 10 is a block diagram showing the interconnection between the hydraulic source means and a portion of the hydraulic control means, and also contains a schematic showing the wiring to the pump motor.

FIG. 11 is a graph showing the representative rate of motion of the carriage as a function of encoder count pulses.

DESCRIPTION OF THE PREFERRED EMBODIMENT

Figure 1:
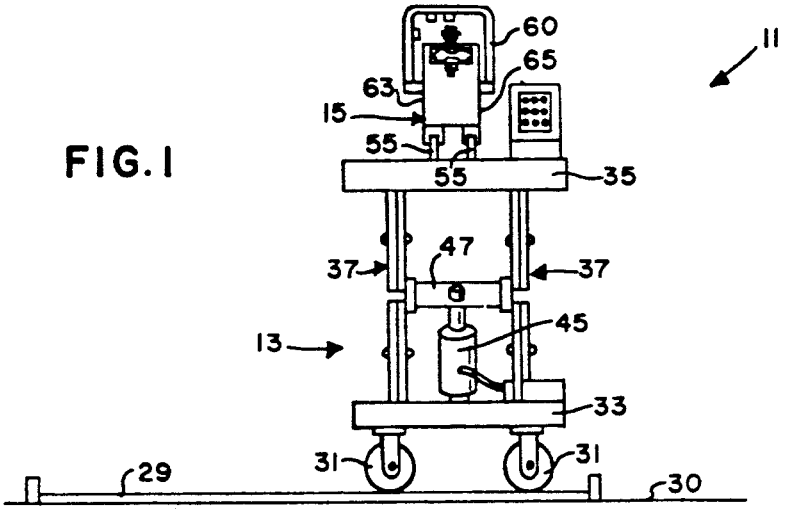
FIG. 1 is an end view of the tubing expander of the present invention.

The tubing expander 11 of the present invention includes in general a base 13; an elongated frame 15; one or more rods 17, each having an enlargement 19 on the forward end thereof for insertion into tubing 21 to be expanded; a carriage 23 movably mounted on frame 15 for movement forwardly and rearwardly relative to frame 15; and support members 25 respectively supporting rods 17 on carriage 23.

In the drawings two rods 17 and two tubes 21 to be expanded are shown along with the components used in conjunction therewith, but it will be understood that more or less than two may be utilized without departing from the spirit and scope of the present invention.

Base 13 includes in general a lifting mechanism 27, well known to those skilled in the art, for raising and lowering frame 15 to vertically align rods 17 with the tubes 21 to be expanded. Base 13 also includes track means comprising a pair of rails 29 supported from the floor 30 or the like and extending substantially perpendicular to frame 15, and wheels 31 rollingly supporting lifting mechanism 27 on rails 29 in a manner well known to those skilled in the art for lateral manual movement of base 13 to laterally align rods 17 with tubes 21 to be expanded.

Lifting mechanism 27 includes a lower platform 33, an upper platform 35, and a pair of lazy tongs 37 interposed between and operably connected respectively to lower platform 33 and upper platform 35. Lazy tongs 37 are of a construction well known to those skilled in the art with the upper ends thereof being pivotally attached to upper platform 35 as at pivot points 39, 40 and are pivotally attached adjacent the lower ends thereof to lower platform 33 as at pivot points 41, 43. Pivot points 43 are slidably attached to lower platform 33 by suitable means well known to those skilled in the art as by means of slots 44 in lower platform 33 in which pivot point 43 slides. Similarly the upper pivot points 40 slidably engage with upper platform 35 in a slot 44. Thus, the upper ends and the lower ends of the lifting mechanism 27 can move inwardly towards one another when the upper platform 35 is raised and moved outwardly away from one another as the upper platform is lowered.

In addition, lifting mechanism 27 includes a hydraulic jack 45 of well known construction, which is operably attached to lazy tongs 37 by suitable well known means as for example by the transverse member 47, which in turn extends between the two lazy tongs 37 and is pivotally attached thereto by suitable means well known to those skilled in the art.

A suitable pressurized hydraulic fluid source 49 such as a pump, electric motor, and reservoir shown somewhat diagrammatically as at 49 and well known to those skilled in the art is provided for controlling the hydraulic jack 45 to raise and lower the frame 15. A control switch 51 mounted on frame 15 is operably connected to the hydraulic fluid source 49, in a manner well known to those skilled in the art, so that the operator can actuate the control switch 51 to cause the above mentioned raising or lowering of the frame 15.

Frame 15 is preferably mounted on upper platform 35 in such a manner that allows for a limited rearward and forward movement of frame 15 relative to upper platform 35. This limited movement may be provided by any suitable means well known to those skilled in the art, as for example, by the preferred manner best seen in FIGS. 1 and 2 with six of such means being provided and with each comprising a forwardly an rearwardly extending bar 53 fixedly supported from upper platform 35 by the supports 55, and a lug 57 fixedly attached to frame 15 and having a hole, not shown, therethrough to slidably mount the lug 57 on bar 53. Thus the operator of the tubing expander 11 can manually shift the frame 15 forwardly or rearwardly on bars 53 between the limits imposed by the supports 55.

Frame 15 is constructed of suitable structural members well known to those skilled in the art. Frame 15 includes braces 59 that are spaced along the length of the frame, and angle members extending along the length of the frame and fixedly attached to braces 59 to provide the frame with rigidity and an open center portion along the length thereof. The sides 63, 65, top 67 and bottom 69 of frame 15 are preferably closed as by panels of plastic or the like for purposes of safety.

The upper surfaces 71 of angle member 61 provide means for movably supporting carriage 23 so that the carriage may be moved forwardly and rearwardly in frame 15 my means later to be described. In other words, carriage 23 is slidable on surfaces 71 for movement lengthwise of the frame 15.

There is a separate support member 25 for each of the rods 17. Each of the support members includes a horizontally disposed block 73, a vertical portion 75 and a cylindrical portion 77. Vertical portion 75 is fixedly attached at the lower end thereof to block 73 and is fixedly attached adjacent the upper end thereof to cylindrical portion 77, as by forming the block 73, vertical portion 75 and cylindrical portion 77 integral. There are a plurality of holes 79 vertically through carriage 23 and a corresponding plurality of holes 81 in block 73 in alignment with holes 81 for nut and bolt fasteners 83 to extend therethrough to removably hold support member 25 on carriage 23.

There is an internally threaded bore 85 provided in cylindrical portion 77 of support member 25 which threadedly and removably receives the externally threaded rearward end portion 87 of rod 17. Elongated tubes 89 respectively partially surround rods 17 and the upper part of support members 25. Each of the tubes 89 is provided with a slot 91 along the length of the bottom thereof through which extends vertical portion 75.

Braces 59 are in pairs, that is, a brace of each pair being on one side of the frame 15 and the other brace of that pair being on the other side of the frame member. At each of the pairs of braces 59 is provided a cross member 93 extending between the braces of each pair and removably attached thereto as by the fasteners 95 which are preferably in the form of nut/bolt fasteners extending through aligned apertures 97, 99 respectively in the braces 59 and in the cross members 93 as best seen in FIG. 4.

Each of the cross members 93 are provided with arcuate slots 101 conforming to and receiving the upper portion of tubes 89, which tubes are fixedly attached to the cross members 93 by suitable means as welding or the like to support the tubes in surrounding relationship to the rods 17 and upper portion of support members 25. The tubes 89 are spaced outwardly from support members 25 and rods 15. Thus, although the rods 17 do not touch the interior of the tubes 89, it will be understood that if there is any lateral or bowing movements of the rods as for example due to the fast speed and length thereof, the tubes will limit lateral or bowing movements of the rods.

A clamping jaw mechanism 103 is provided in tubing expander 11 adjacent the forward end 104 of tubing expander 11 for clampingly holding the ends of the tubes 21 to be expanded. Clamping jaw mechanism 103 includes an upper jaw member 105, a lower jaw member 107 and means for pivotally removably attaching jaw members 105, 107 to frame 15, which means is by suitable means now well known to those skilled in the art such as the attachment means 109. Each of the clamping jaw mechanisms 103 has provisions for clamping a corresponding number of tubes 21 which are being expanded on the tubing expander 11 at the same time. Thus with the expander illustrated in the drawings having two tubes 21 to be expanded, upper jaw 105 has a pair of arcuate surfaces 111 conforming to the outside upper surfaces of the tubes 21 and having teeth thereon, as best seen in FIG. 6 (only one of which is shown). Similarly, lower jaw 105 has a pair of arcuate surfaces 111 conforming to the outside lower surfaces of the tubes 21 and having teeth thereon, as best seen in FIG. 6 (only one of which is shown). The inner surface 113 of upper jaw 105 and the inner surface 115 of lower jaw 107 slope forwardly away from one another to provide camming means engageable by enlargements 19, which are preferably in the form of enlarged balls, to cam open jaw mechanism 103 when enlargements 19 are retracted rearwardly into jaw mechanism 103. Suitable means for urging jaw members 105, 107 together is provided, which may be in the form of a spring mechanism 117 best seen in FIGS. 5, 6 and 8, but if desired may be in the form of a hydraulic cylinder. Spring mechanism 117 includes a spring 119 extending between upper jaw 105 and a spring seat 121 which is preferably in the form of a washer, bolt 123 extending through apertures, not shown, in jaw members 105, 107 and a nut 125 threadedly provided on bolt 123 below jaw member 107. Thus, spring mechanism 117 urges the jaw members 105, 107 towards one another in clamping engagement with the tubes 21 when rods 17 are moved forwardly towards the tubes to be expanded.

Drive means 127 is operably coupled to carriage 23 for moving the carriage forwardly and rearwardly to carry the enlargements 19 on the forward end of rods 17 into the tubes 21 to be expanded and subsequently rearwardly out of the tubes 21 after the expansion thereof.

Figure 3:
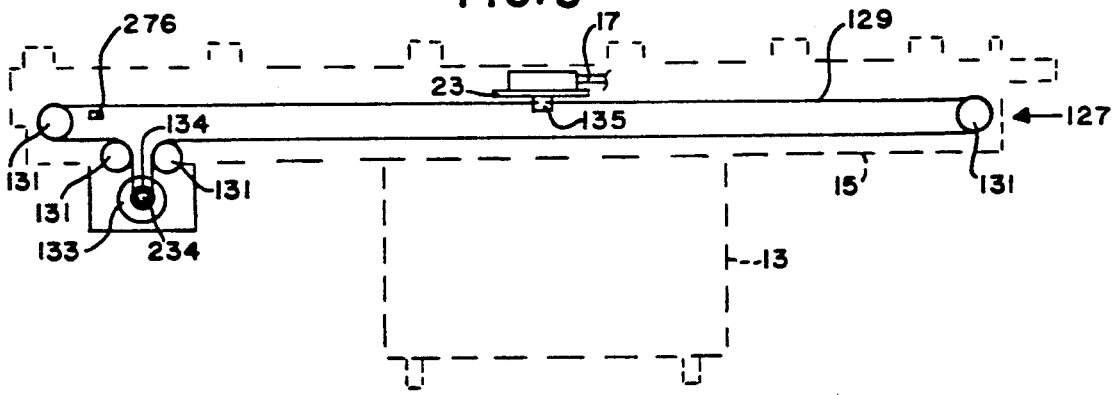
FIG. 3 is a diagrammatic view showing portions of the drive mechanism of the present invention.

Drive means 127 includes a continuous chain 129 which extends over idler sprockets 131 , as best seen in FIG. 3 and is driven by reversible hydraulic motor 133 which has a drive sprocket 134 fixedly attached to the shaft, not shown, of motor 133 and which chain 129 engages for the drive thereof. The upper flight of chain 129 extends from one end of frame 15 to the other and is operably coupled to carriage 23 by suitable means well known to those skilled in the art which is preferably a lug 135 fixedly attached to the bottom of carriage 23 and serves as a link between the ends 129', 129 of the chain 129 so that as the upper flight of the chain moves forwardly or rearwardly, the carriage 23 also moves forwardly or rearwardly therewith.

Figure 9:
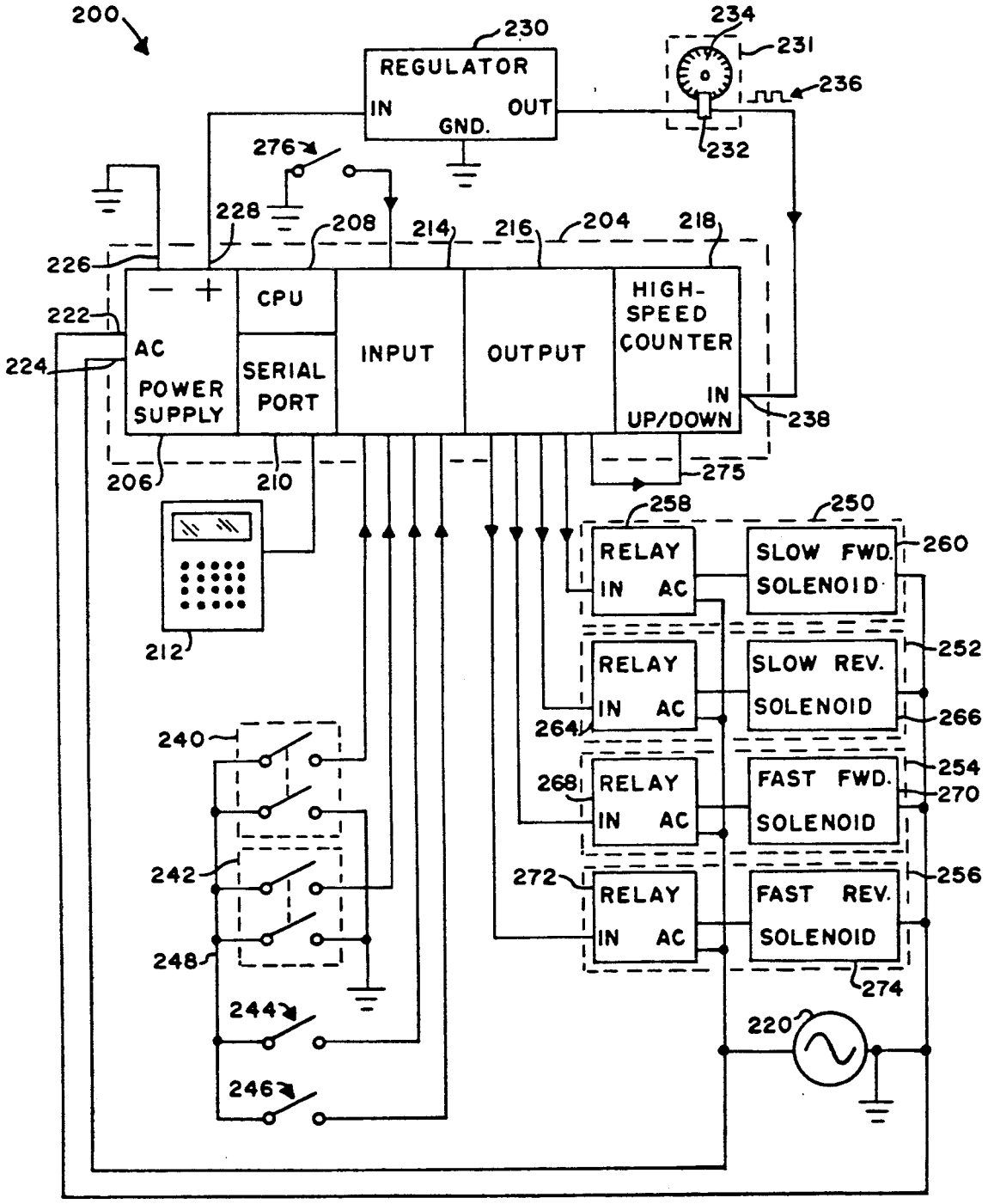
FIG. 9 is a schematic block diagram showing the interconnection of the Programmable Logic Controller with the carriage movement monitoring means and operator interface, as well as with various switches and solid-state relays.

The operation of hydraulic motor 133, which, in turn, causes carriage 23 to move forwardly and rearwardly, is controlled by hydraulic control means 200, a portion of which is shown in FIG. 9, with the remaining portion shown in FIG. 10 along with hydraulic source means 202. It should be noted that the various solenoid means for operating the various hydraulic valves which provide fluid to hydraulic motor 133, each hereinafter described, are repeated in both FIGS. 9 and 10 for clarity in showing the interconnection therewith. Hydraulic motor 133 is a bi-directional hydraulic motor, well known to those skilled in the art, turning its shaft counterclockwise or clockwise at a rate proportional to the rate of hydraulic fluid passing through the motor.

In the preferred embodiment, operation of hydraulic control means 200 is directed by Programmable Logic Controller (PLC) means 204, such as a Model 90-30 PLC manufactured by the General Electric Company, well known to those skilled in the art, included within hydraulic control means 200, for sequencing the operation of hydraulic control means 200. PLC means 204 includes a power supply 206, a central processing unit (CPU) 208, a serial input port 210 for interfacing with an operator interface 212, an input module 214, an output module 216, and a high-speed counter 218. Input module 214, output module 216, and high-speed counter 218 are preferably snap-in modules chosen for compatibility with the particular PLC selected, and operator interface 212 may preferably be one made by Horner Electric Company, similarly chosen for compatibility with the PLC. Power supply 206 converts power from a power source, such as 120 volt alternating current (AC) power source 220 connected to inputs 222, 224 of power supply 206, into a direct current (DC) voltage, typically 24 volts DC, at outputs 226, 228 of power supply 206. This latter voltage is converted, through regulator 230, well known to those skilled in the art, to typically 12 volts DC which, in turn, powers detection and phase-lock loop (PLL) circuitry 232, hereinafter described.

Hydraulic control means 200 also includes carriage movement monitoring means 231 for sensing the movement of carriage 23 as carriage 23 travels forwardly and rearwardly. Monitoring means 231 includes an encoder wheel 234 as well as detection and PLL circuitry 232, each well known to those skilled in the art. Detection and PLL circuitry 232 senses the rotation of encoder wheel 234, mounted on the shaft of hydraulic motor 133, thereby sensing the motion of chain 129 and carriage 23. Detection and PLL circuitry 232 creates a train of pulses 236 corresponding to the angular rotation of encoder wheel 234, typically 600 pulses per revolution, in a manner well known to those skilled in the art, which are then fed to counting input 238 of high-speed counter 218. High-speed counter 218 and monitoring means 231 are thus seen to comprise a carriage position sensing means for sensing the actual position of carriage 23, since each pulse of pulse train 236 will correspond to a certain known displacement, typically 1/80th of an inch, of carriage 23, with the count recorded in high-speed counter 218 providing a summary of the motion of carriage 23. It will be understood that the precise displacement corresponding to each pulse of pulse train 236 is determined, in a manner well known to those skilled in the art, by the number of counts per revolution of encoder wheel 234 as well as the spacing and number of teeth on drive sprocket 134, attached to the shaft of hydraulic motor 133, which drives chain 129.

Figure 2:
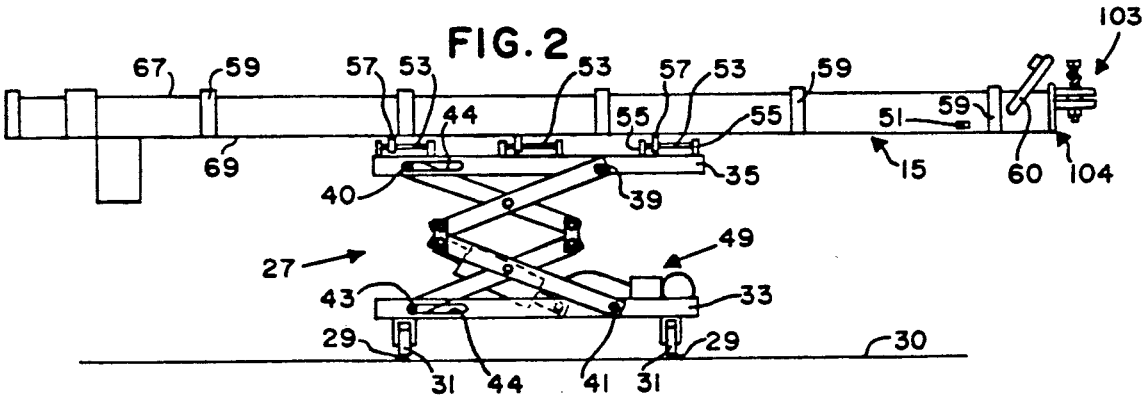
FIG. 2 is a side elevational view of the tubing expander of FIG. 1.

Input module 214 receives a variety of inputs from switches, mounted on handle 60 shown in FIG. 1, which are set by the operator to parameterize and direct the operation of tubing expander 11. These switches include a fast mode switch 240 and a slow mode switch 242 for directing the tubing expander to operate in a fast or a slow mode, respectively, as well as a forward mode switch 244 and a reverse mode switch 246 for directing the tubing expander to move the carriage in a forward or a rearward direction, respectively. Fast and slow mode switches 240 and 242 may be chosen to each be double pole single throw (DPST) switches, or preferably chosen to be combined to be a double pole three position (DP3P) switch, with a center position in which neither switch 240 nor switch 242 is activated, another position in which only switch 240 is activated, and still another position in which only switch 242 is activated, in a manner now apparent to those skilled in the art. Similarly, forward and reverse mode switches 244 and 246 may be chosen to each be a single pole single throw (SPST) switch, or preferably chosen to be combined to be a single pole three position (SP3P) switch, with a center position in which neither switch 244 nor switch 246 is activated, another position in which only switch 244 is activated, and still another position in which only switch 246 is activated, in a manner now apparent to those skilled in the art. As seen in FIG. 9, operation of either fast mode switch 240 or slow mode switch 242 applies a ground potential to node 248, enabling forward mode switch 244 or reverse mode switch 246 to, in turn, supply an asserted (grounded) input to input module 214, thereby preventing, as an interlocking safety feature requiring two-handed operation by the operator, input module 214 from sensing an asserted (grounded) input from either forward mode switch 244 or reverse mode switch 246 unless also either fast mode switch 240 or slow mode switch 242 is activated. Operation of fast mode switch 240 or slow mode switch 242 is also seen to supply an asserted (grounded) input to input module 214 from either of those switches. Those skilled in th=art will now recognize that input module 214 can thus sense the activation of switches 240, 242, 244, and 246, subject to the above mentioned interlocking safety feature.

Output module 216 can control a plurality of hydraulic valve control means for controlling each of the various hydraulic valves which allow hydraulic fluid to flow to hydraulic motor 133. Each of these hydraulic valve control means, such as slow forward valve control means 250, slow reverse valve control means 252, fast forward valve control means 254, and fast reverse valve control means 256, includes solenoid means, well known to those skilled in the art, for operating the respective hydraulic valve, and additionally includes solid state relay means, also well known to those skilled in the art, for allowing a typically low voltage input signal, typically 3 to 32 volts DC, such as that supplied by output module 216, to switch a higher voltage signal typically up to 5 amperes at 120 volts AC, such as that from power source 220, required to operate the associated solenoid means.

Slow forward valve control means 250, including solid state relay means 258 and slow forward solenoid means 260, is for operating a hydraulic valve, well known to those skilled in the art, within hydraulic valve group 262 shown in FIG. 10, which, in turn, causes a certain amount of hydraulic fluid to flow through hydraulic motor 133, causing the shaft of hydraulic motor 133 to turn in a direction that makes carriage 23 move slowly in the forward direction.

Similarly, slow reverse valve control means 252, including solid state relay means 264 and slow reverse solenoid means 266, is for operating a similar hydraulic valve within hydraulic valve group 262 which, in turn, causes a certain amount of hydraulic fluid to flow to flow through hydraulic motor 133, causing the shaft of hydraulic motor 133 to turn in a direction that makes carriage 23 move slowly in the reverse direction. Likewise, fast forward valve control means 254, including solid state relay means 268 and fast forward solenoid means 270, as well as fast reverse valve control means 256, including solid state relay means 272 and fast reverse solenoid means 274, respectively operate similar hydraulic valves within hydraulic valve group 262, causing the shaft of hydraulic motor 133 to turn in a direction that makes carriage 23 move rapidly in the respective forward and reverse directions.

In order to cause carriage 23 to move slowly in the forward direction, only the valve within hydraulic valve group 262 associated with slow forward valve control means 250 will be activated, causing a certain small amount of hydraulic fluid to flow through hydraulic motor 133 in one direction. In order to cause carriage 23 to move slowly in the reverse direction, only the valve within hydraulic valve group 262 associated with slow reverse valve control means 252 will be activated, causing a certain small amount of hydraulic fluid to flow through hydraulic motor 133 in the other direction. The exact flow rate of fluid that flows through hydraulic motor 133 may be determined by restrictions in the respective fluid lines between the respective valves and hydraulic motor 133 in a manner well known to those skilled in the art.

In order to cause carriage 23 to move rapidly in the forward or reverse direction, the valve associated with either fast forward valve control means 254 or fast reverse valve control means 256 will be activated, either independently or preferably in conjunction with the associated slow forward or slow reverse valve control means, 250 or 252, respectively, causing a certain large amount of hydraulic fluid to flow through hydraulic motor 133 in the desired direction. In this manner, the shaft of hydraulic motor 133 will be understood to be caused to rotate slowly or quickly in either direction. It is not required that the slow movement in the forward and reverse directions be at the same rate, nor is it required that the fast movement in the forward and reverse directions be the same, as each rate can be appropriately chosen, in a manner well known to those skilled in the art, by appropriate restrictions or regulator valves in the fluid lines between each valve and hydraulic motor 133

Output module 216 also supplies a signal 275 to high-speed counter 218 for directing high-speed counter to count upwardly or downwardly, depending on whether carriage 23 is moving forwardly or rearwardly, respectively, so that the counts recorded by high-speed counter correspond to the distance of carriage 23 from its nominal "home" or resting position in which it is fully retracted.

Additionally, input module 214 monitors proximity switch means 276 for sensing when carriage 23 is a certain distance, typically chosen to be eight or ten inches, from the "home" position and for presetting high-speed counter 218 to a count value corresponding to that certain distance. This presetting of high-speed counter 218 occurs only when carriage 23 is moving rearwardly, and provides calibration of the precise position of carriage 23 on each stroke cycle, allowing high-speed counter 218 to count down to zero from the preset value and accurately stop at the "home" position. This "home" position is preferably chosen to be the position where enlarged ball 19 cams open jaw members 105 and 107, thereby allowing the insertion and removal of tubing 21. The recalibration of high-speed counter 218 on each stroke cycle provides for greater precision and control of the stroke distance traveled by carriage 23, compensating for chain and sprocket wear as well as possible imprecision within carriage movement monitoring means 231. Note that it is important, when large balls 19 are used, to prevent retraction of ball 19 past the "home" position, as damage to tubing expander 11 could result were enlarged ball 19 to be forcibly retracted into tube 89 through the rear of jaw members 105 and 107. Accurate calibration of the position of carriage 23 is necessary to prevent the aforementioned damage.

It should also be noted that the "home" position of carriage 23 varies slightly with the exact size of ball 19 chosen as well as with the precise length of a particular rod 17. As the camming movement of jaw members 105 and 107 will be understood to be affected by the size of ball 19, operator interface 212 allows the exact preset value that will be loaded into high speed counter 218 when proximity switch 276 is activated to be chosen to correspond to the particular size of ball 19 in use, thereby establishing the distance that will be counted down from the activation of the proximity switch until the "home" position is reached.

The interrogation of the inputs to input module 214, the setting of outputs from output module 216, the receipt of operator inputs from operator interface 212 through serial port 215, and the interrogation of the contents of high speed counter 218 is controlled by CPU 208, operating in a manner hereinafter described.

Turning now to FIG. 10, hydraulic source means 202 is shown to include a hydraulic pump means 278, well known to those skilled in the art, for pumping hydraulic fluid to and from valve group 262 and, thereby indirectly, to and from hydraulic motor 133. Typically, hydraulic source means 202 may also include a hydraulic fluid reservoir and other suitable related components and conduits, not shown but well known to those skilled in the art, in connection with hydraulic pump means 278 to provide hydraulic fluid to valve group 262. Hydraulic pump means 278 is driven by pump motor 280, preferably a ten horsepower, three phase 480 volt AC electric motor, switched through motor power switch 282 and main power switch 284, connected to a three phase, 480 volt AC source, not shown, through power wires 286. Step down transformer 288 provides typically 120 volt AC power to control relay 294 of motor power switch 282 through motor start switch 290, a normally open, momentary contact single pole single throw (SPST) switch, and motor stop switch 292, a normally closed, single pole single throw (SPST) switch, preferably connected as shown in a latching feedback configuration with contacts 296 of motor power switch 282. It should be noted that once main power switch 284 is closed, supplying power to motor power switch 282. closing motor start switch 290 causes power to be applied to relay 294, which, besides closing contacts 298 which supply power to pump motor 280, also closes contacts 296 which preserve power to relay 294 when motor start switch 290 is released, thereby maintaining power to pump motor 280. Pump motor 280 may be similarly turned off by opening motor stop switch 292, thereby interrupting the flow of power to relay 294, causing contacts 298 to open, removing power from pump motor 280.

Figure 12:
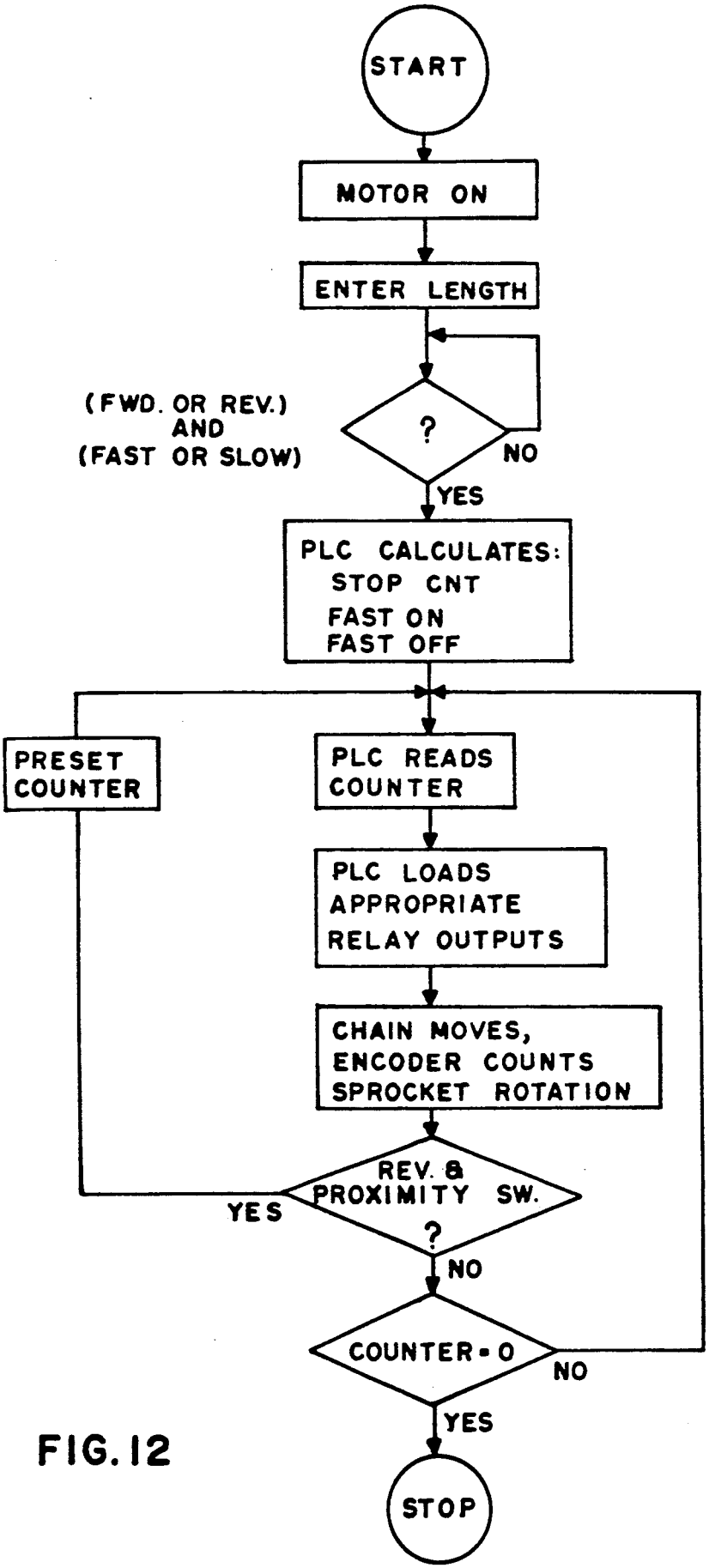
FIG. 12 is a flow diagram describing the operation of the Programmable Logic Controller.

Referring now to FIG. 12, the operation of tubing expander 11 will now be described. The operator first turns on pump motor 280 by operating motor start switch 290 as previously described, and enters the desired length of travel for carriage 23, corresponding to the particular workpiece being expanded, into operator interface 212. PLC means 204 then awaits the simultaneous depressing of either forward or reverse mode switch 244 or 246 respectively with either fast or slow mode switch 240 or 242 respectively, thereby ensuring two-handed operation of tubing expander 11 by the operator for safety. PLC means 204 then calculates the STOP, FAST ON, and FAST OFF counts from the desired length of travel. The STOP count corresponds to the number of encoder pulses 236 calculated to occur between the "home" position and the desired length of travel. The FAST ON count corresponds to the number of encoder pulses 236 calculated to occur between the "home" position and the point at which carriage 23 should change from a slow rate of movement to a fast rate of movement, in a manner previously described, by operation of fast forward or reverse valve control means 254 or 256, respectively. Similarly, the FAST OFF count corresponds to the number of encoder pulses 236 calculated to occur between the "home" position and the point at which carriage 23 should change from a fast rate of movement to a slow rate of movement, also in a manner previously described. FIG. 11 shows graphically how the rate of movement for carriage 23 changes as the count presented by high-speed counter 218 goes from zero at the "home" position to the FAST ON value, then to the FAST OFF value, and finally to the STOP value, corresponding to regions of travel of carriage 23 respectively delineated as A, B, and C, respectively, with region D, the region past the STOP, or full travel, position, being hereinafter described.

The provision for fast and slow movement of carriage 23 provides for fast throughput of tubing expander 11, due to the rapid motion of carriage 23 during certain portions of its travel, while maintaining precise control of the stopping points at either end of the travel of carriage 23, which are forced to be reached while carriage 23, having a great deal of inertial mass, is travelling at a slow rate of travel. It should be mentioned that, due to the flexibility afforded by the programmability of PLC means 204, there is not necessarily a requirement that the FAST ON and FAST OFF points be the same in the forward as in the reverse direction, although a single FAST ON count may be used in both directions, as may a single FAST OFF count, for convenience and simplification of calculations.

After performing these calculations, PLC means 204 now enters its operational loop. PLC means 204 first reads the value presented by high-speed counter 218 and loads the appropriate outputs of output module 216 according to Table 1, below, as well as properly setting the state of signal to cause high-speed counter to count up or down, as required, in the forward and reverse directions respectively, as previously described.

TABLE 1

SOLENOIDS ENERGIZED AS A FUNCTION OF DIRECTION AND POSITION

| Direction | Region A | Region B | Region C | Region D |
|---|---|---|---|---|
| FWD | SLOW FWD | SLOW FWD FAST FWD | SLOW FWD | (none) |
| REV | SLOW REV | SLOW REV FAST REV | SLOW REV | SLOW REV |

Instead of actually turning the solenoid means on and off abruptly as might be indicated from Table 1, PLC means 204 may be programmed to pulse the valves during the transitions from one region to the next in order to reduce the abrupt mechanical shock that might otherwise occur, in a manner now understood by those skilled in the art.

It should be noted that when carriage 23 is to move in the reverse direction, slow reverse solenoid means 266 will be energized in region C and also in region D, as the inertia of carriage 23 and the delay in response of the hydraulics from closing all valves at the STOP point may cause carriage 23 to travel a small distance past the STOP point. Also, if the operator chooses to operate tubing expander 11 in a forced slow mode by depressing slow mode switch 242 rather than fast mode switch 240, whether because of the delicacy of the particular workpiece being processed or to verify operation on the initial forward and rearward strokes of carriage 23, PLC means 204 may be programmed to inhibit activating fast forward and reverse valve control means 254 and 256 during region B, thereby restricting the rate of travel of carriage 23 to a slow rate throughout the stroke.

At this point, the shaft of hydraulic motor 133 turns, in a direction and rate controlled by valve group 262, causing chain 129 to move while encoder wheel 234 causes high-speed counter 218 to record sprocket 134 rotation and thereby, chain movement. PLC means 204 then tests to see if proximity switch 276 is actuated while moving in the reverse direction. If so, then high-speed counter 218 is preset, as previously described, with the preset value, and the operational loop starts over. If not, then the value in high-speed counter 218 is tested. If the value in high-speed counter 218 is not equal to zero, then the operational loop is started over if the value in high-speed counter 218 is equal to zero, then PLC means 204 shuts off all forward and reverse valve control means 250, 252, 254, and 256, and terminates. With all valves closed, the shaft of hydraulic motor 133 will be substantially locked in one position, thereby preventing all motion of carriage 23.

The operation of tubing expander 11, as observed by the operator, will be: first, starting at the "home" position, nothing will happen until forward mode switch 244 is pressed coincident with a fast or slow mode switch, 240 or 242, respectively. Note that, since carriage 23 is at the "home" position, PLC means 204 will refuse to move carriage 23 in the reverse direction, so operation of reverse mode switch 246 will have no effect. Also, jaw members 105 and 107 will be cammed open by ball 19, allowing tubing expander 11 to be positioned with tubing 21 inserted into the jaws. Next, carriage 23 will slowly move through region A in the forward direction, causing jaw members 105 and 107 to grip tubing 21. Upon passing the FAST ON point, the motion of carriage 23 will speed up if fast mode switch 240, rather than slow mode switch 242, is activated. Upon passing the FAST OFF point, the motion of carriage 23 will slow down. Upon reaching the STOP point at the desired travel distance, motion of the carriage will cease. At this point, PLC means 204 is still cycling in its operational loop, previously described. When forward mode switch 244 is released and reverse mode switch 246 is instead activated, carriage 23 will begin moving rearwardly at a slow rate through region C. When the FAST OFF point is passed in the reverse direction, the motion of carriage 23 will speed up if fast mode switch 240, rather than slow mode switch 242, is activated. Upon passing the FAST ON point, carriage 23 will slow down, and finally stop at the "home" position with jaw members 105 and 107 cammed open, at which point the operator will position tubing expander 11 at the next tubes to be expanded on the workpiece, and the cycle will repeat.

From the foregoing description it will be understood that the present invention provides a tubing expander that among other things is versatile so that the expander may be quickly and easily changed from one tube spacing to another or one size heat transfer coil to another and yet provide an expander that is fast in operation, easy to maintain, easy to operate, highly effective and adaptable to different types of tubing.

Although the present invention has been described and illustrated with respect to a preferred embodiment and a preferred use therefor, it is not to be so limited since modifications and changes can be made therein which are within the full intended scope of the invention.

We claim:

1. An expander for expanding tubing comprising:

(a) a base;

(b) an elongated frame mounted on said base;

(c) elongated rod means for the expansion of said tubing, said rod means having an enlarged forward end larger than the unexpanded inner diameter of said tubing and insertable into said tubing;

(d) a carriage movably mounted on said elongated frame for movement forwardly and rearwardly relative to said elongated frame;

(e) support means for removably supporting said rod means on said carriage;

(f) elongated tube means partially surrounding said rod means for limiting lateral or bowing movements of said rod means;

(g) means for removably supporting said elongated tube means from said elongated frame;

(h) clamping jaw means adjacent the forward end of said elongated frame for clampingly holding the end of the tubing;

(i) means for removably supporting said clamping jaw means from said elongated frame; and (j) motor-powered drive means operably coupled to said carriage for moving said carriage forwardly and rearwardly to carry the forward end of said rod means into the tubing for the expansion of the tubing and subsequently rearwardly out of the tubing after the expansion thereof, said drive means including:

i. an idler sprocket rotatably attached to said elongated frame, ii. a continuous length of chain having first and second ends thereof, said chain engaging said idler sprocket with said first and second ends thereof attached to said carriage;

iii. reversible hydraulic motor means including a drive sprocket engaging said chain for the drive thereof, iv. hydraulic source means for supplying hydraulic fluid under pressure to said hydraulic motor means; and v. hydraulic control means for controlling the rate and direction of hydraulic fluid flow to said hydraulic motor means to selectively cause said hydraulic motor means to move said rod means forwardly or rearwardly at a fast or slow rate, and to stop said rod means at the rearward and forward ends of its stroke.

2. An expander for expanding tubing comprising:

(a) a base;

(b) an elongated frame mounted on said base;

(c) elongated rod means for the expansion of said tubing, said rod means including an enlarged ball on the forward end thereof larger than the unexpanded inner diameter of said tubing and insertable into said tubing;

(d) elongated tube means partially surrounding said rod means for limiting lateral or bowing movements of said rod means;

(e) means for removably supporting said elongated tube means from said elongated frame;

(f) clamping jaw means adjacent the forward end of said elongated frame for clampingly holding the end of the tubing, said clamping jaw means including a pivoted upper jaw member and a pivoted lower jaw member, said upper jaw member and lower jaw member respectively having inner surface sloping forwardly away from one another to provide camming means engageable by said enlarged ball for camming open said clamping jaw means when said enlarged ball is retracted rearwardly into said clamping jaw means, and said clamping jaw means including means for urging said upper and lower jaw members together and in clamping engagement with the tubing when said rod means is moved forwardly towards the tubing;

(g) means for removably supporting said clamping jaw means from said elongated frame;

(h) a carriage movably mounted on said elongated frame for movement forwardly and rearwardly relative to said elongated frame;

(i) support means for removably supporting said rod means on said carriage; and (j) drive means operably coupled to said carriage for moving said carriage forwardly and rearwardly to carry the forward end of said rod means into the tubing for the expansion of the tubing and subsequently rearwardly out of the tubing after the expansion thereof, said drive means including an idler sprocket rotatably attached to said elongated frame, a continuous length of chain having first and second ends thereof, said chain engaging said idler sprocket with said first and second ends thereof attached to said carriage, reversible hydraulic motor means including a drive sprocket engaging said chain for the drive thereof, hydraulic source means for supplying hydraulic fluid under pressure to said hydraulic motor means, and hydraulic control means for controlling the rate and direction of hydraulic fluid flow to said hydraulic motor means to selectively cause said hydraulic motor means to move said rod means forwardly or rearwardly at a fast or slow rate, and to stop said rod means at the rearward and forward ends of its stroke.

3. The expander of claim 2 in which said base comprises:

(a) lifting means for raising and lowering said elongated frame to vertically align said rod means with the tubing;

(b) a track extending substantially perpendicular to said elongated frame; and (c) wheel means for rollingly supporting said lifting means on said track and for lateral movement of said base to laterally align said rod means with the tubing.

4. The expander of claim 3 in which said lifting means comprises a lazy-tong mechanism and motor means for extending and retracting said lazy-tong mechanism to raise and lower said elongated frame.

5. An expander for expanding tubing comprising:

(a) a base;

(b) an elongated frame mounted on said base;

(c) elongated rod means for the expansion of said tubing, said rod means having an enlarged forward end larger than the unexpanded inner diameter of said tubing and insertable into said tubing;

(d) a carriage movably mounted on said elongated frame for movement forwardly and rearwardly relative to said elongated frame;

(e) support means for removably supporting said rod means on said carriage;

(f) an idler sprocket rotatable attached to said elongated frame;

(g) a continuous length of chain having first and second ends thereof, said chain engaging said idler sprocket with said first and second ends thereof attached to said carriage;

(h) reversible hydraulic motor means including a drive sprocket engaging said chain for the drive thereof;

(i) hydraulic source means for supplying hydraulic fluid under pressure to said hydraulic motor means;

(j) carriage movement monitoring means for sensing the movement of said carriage as said carriage moves forwardly and rearwardly; and (k) hydraulic control means operably responsive to said carriage movement monitoring means and operably coupled to said hydraulic motor means for controlling the movement of said carriage.

6. The expander of claim 5 in which said carriage movement monitoring means includes an encoder wheel operably coupled to said chain and a detection and phase-lock loop circuitry means operably coupled to said encoder wheel for monitoring the rotation of said encoder wheel and thereby for monitoring the movement of the carriage.

7. The expander of claim 6 in which said hydraulic control means includes a programmable logic controller means for sequencing the operation of said hydraulic control means in a selected fast, slow or stop mode.

8. The expander of claim 2 in which enlarged ball is non-rotating as it is inserted into said tubing.

* * * * *